US010629364B2

(12) United States Patent
Paeng et al.

(10) Patent No.: US 10,629,364 B2
(45) Date of Patent: Apr. 21, 2020

(54) INDUCTOR AND METHOD FOR MANUFACTURING THE SAME

(71) Applicant: SAMSUNG ELECTRO-MECHANICS CO., LTD., Suwon-si, Gyeonggi-do (KR)

(72) Inventors: Se Woong Paeng, Suwon-si (KR); Jong Seok Bae, Suwon-si (KR); Soo Yeol Kim, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 60 days.

(21) Appl. No.: 15/716,579

(22) Filed: Sep. 27, 2017

(65) Prior Publication Data

US 2018/0301277 A1 Oct. 18, 2018

(30) Foreign Application Priority Data

Apr. 12, 2017 (KR) ..... 10-2017-0047310

(51) Int. Cl.

| | |
|---|---|
| ***H01F 17/00*** | (2006.01) |
| ***H01F 27/29*** | (2006.01) |
| ***H01F 41/10*** | (2006.01) |
| *H01F 5/00* | (2006.01) |
| *H01F 41/04* | (2006.01) |

(52) U.S. Cl.

CPC ..... *H01F 27/292* (2013.01); *H01F 17/0013* (2013.01); *H01F 41/10* (2013.01); *H01F 41/041* (2013.01); *H01F 2005/006* (2013.01); *H01F 2017/002* (2013.01); *H01F 2017/004* (2013.01)

(58) Field of Classification Search

CPC ..... H01F 27/292

USPC ..... 336/200, 232

See application file for complete search history.

(56) References Cited

U.S. PATENT DOCUMENTS

| | | | | |
|---|---|---|---|---|
| 6,713,162 | B2 * | 3/2004 | Takaya | H03H 7/0115 428/209 |
| 8,188,827 | B2 * | 5/2012 | Okawa | H01F 27/34 336/192 |
| 10,147,533 | B2 | 12/2018 | Lyoo et al. | |
| 2004/0017279 | A1 * | 1/2004 | Kamoshima | H01L 23/5258 336/200 |
| 2005/0136646 | A1 | 6/2005 | Larnerd et al. | |

(Continued)

FOREIGN PATENT DOCUMENTS

| | | | |
|---|---|---|---|
| EP | 1545175 | A2 | 6/2005 |
| JP | 2001-217550 | A | 10/2001 |

(Continued)

OTHER PUBLICATIONS

Korean Office Action dated Dec. 21, 2017 issued in Korean Patent Application No. 10-2017-0047310 (with English translation).

(Continued)

*Primary Examiner* — Tszfung J Chan

(74) *Attorney, Agent, or Firm* — Morgan, Lewis & Bockius LLP

(57) ABSTRACT

An inductor includes a body in which is disposed a coil formed as a plurality of coil patterns connected by one or more via(s). Each via includes a first conductive layer and a second conductive layer formed on the first conductive layer, and a distance between portions of coil patterns connected by the via in the body is greater than a distance between other portions of the coil patterns in the body. Methods of forming inductors having vias including first and second conductive layers are also provided.

19 Claims, 7 Drawing Sheets

(56) References Cited

U.S. PATENT DOCUMENTS

| | | | | |
|---|---|---|---|---|
| 2006/0022787 | A1* | 2/2006 | Brennan | H01F 17/0006 336/200 |
| 2011/0102124 | A1 | 5/2011 | Matsushita | |
| 2013/0176096 | A1* | 7/2013 | Takahashi | H01F 27/2804 336/200 |
| 2014/0306792 | A1* | 10/2014 | Yoneda | H01F 27/2804 336/200 |
| 2015/0340150 | A1* | 11/2015 | Nakamura | H01F 27/24 336/200 |
| 2016/0343499 | A1 | 11/2016 | Nakamura et al. | |
| 2016/0351321 | A1* | 12/2016 | Lyoo | H01F 27/2804 |
| 2017/0110237 | A1* | 4/2017 | Kim | H01F 27/2847 |
| 2017/0301453 | A1* | 10/2017 | Jo | H01F 27/2804 |

FOREIGN PATENT DOCUMENTS

| | | | | |
|---|---|---|---|---|
| JP | 2003-037366 | A | | 2/2003 |
| JP | 2003037366 | A | * | 2/2003 |
| JP | 2003168865 | A | * | 6/2003 |
| JP | 2004-296497 | A | | 1/2004 |
| JP | 2005-183952 | A | | 7/2005 |
| JP | 2009-152347 | A | | 7/2009 |
| JP | 2009277972 | A | * | 11/2009 |
| JP | 2015-041693 | A | | 3/2015 |
| JP | 2015-070175 | A | | 4/2015 |
| JP | 2015070175 | A | * | 4/2015 |
| JP | 2016-001734 | A | | 1/2016 |
| JP | 2016-225611 | A | | 12/2016 |
| KR | 10-2016-0140307 | A | | 12/2016 |
| WO | 2010/007858 | A1 | | 1/2010 |

OTHER PUBLICATIONS

Notice of Office Action issued in Japanese Patent Application No. 2017-184157, dated Apr. 24, 2018 (with English translation).

Japanese Office Action dated Nov. 27, 2018 issued in Japanese Patent Application No. 2017-184157 (with English translation).

* cited by examiner

INDUCTOR AND METHOD FOR MANUFACTURING THE SAME

CROSS-REFERENCE TO RELATED APPLICATION(S)

This application claims benefit of priority to Korean Patent Application No. 10-2017-0047310 filed on Apr. 12, 2017 in the Korean Intellectual Property Office, the disclosure of which is incorporated herein by reference in its entirety.

BACKGROUND

1. Field

The present disclosure relates to an inductor and a method for manufacturing the same.

2. Description of Related Art

A general multilayer inductor has a structure in which a plurality of insulating layers each having a conductive pattern formed thereon are stacked, and in which the conductive patterns are sequentially connected by conductive vias formed in the respective insulating layers. The interconnected patterns thereby form a coil having a spiral structure. Both ends of the coil are led out to external surfaces of a multilayer body and connected to external terminals.

An inductor is generally provided as a surface-mount device type that can be mounted on a circuit board. In particular, high-frequency inductors, used at a high frequency of 100 MHz or higher, are increasingly used in devices on the communications market. The most important feature of the high-frequency inductors is securing high quality (Q) factor characteristics indicating efficiency of chip inductors. Here, $Q=wL/R$, where the value Q is a ratio of inductance (L) and resistance R in a given frequency band.

Since inductor products are manufactured to provide specific nominal capacity (inductance (L)), it is commonly required that inductors also provide high Q characteristics at the same capacity. In order to increase Q characteristics at the same capacity, it is common to lower resistance (R) and, in order to lower resistance (R), a thickness of a coil pattern is commonly increased. The coil pattern is manufactured through a screen printing method, but there is a limitation in increasing a thickness of the coil pattern through the screen printing method. Also, in the case of forming a thick coil pattern on a ceramic layer, when a plurality of sheets are stacked, cracking or delamination may occur due to the presence of a step between a portion in which the coil pattern is formed and a portion in which a coil is not formed.

In addition, the vias connecting coil patterns may be formed by plating a metal or printing a conductive paste. Here, the formation of vias using metal plating may lead to an increase in hardness of the metal, causing interlayer insulation distances to be nonuniform during stacking. Additionally, formation of the vias using conductive paste may lead to an increase in resistance of the coil to reduce Q characteristics of the inductor.

Thus, a need exists for an inductor having a structure capable of securing a uniform insulation distance during stacking, while lowering resistance of the coil.

SUMMARY

When interlayer insulation distances of coil patterns are not uniform, it is difficult to secure Q characteristics of an inductor.

An aspect of the present disclosure may provide an inductor including one or more via(s) each having first and second conductive layers formed of heterogeneous metals, thus lowering resistance of a coil to enhance Q characteristics.

Another aspect of the present disclosure may provide an inductor in which a thickness of a second conductive layer, among first and second conductive layers of a via, is limited, to secure reliability of a connection between interlayer coils after the coils are connected.

According to an aspect of the present disclosure, an inductor may include a body in which a coil formed as a plurality of coil patterns connected by one or more vias is disposed. Each via of the one or more vias includes a first conductive layer and a second conductive layer formed on the first conductive layer. A distance between portions of coil patterns connected by the vias is greater than a distance between other portions of the coil patterns.

According to another aspect of the present disclosure, a method for manufacturing an inductor may include forming a coil pattern on a substrate, and forming an insulating layer on the substrate to cover the coil pattern. A through hole is formed in the insulating layer to extend from a surface of the insulating layer to the coil pattern. A first conductive layer is formed within the through hole through plating, and a second conductive layer is formed on the first conductive layer through plating to form a via including the first and second conductive layers. The substrate is separated from the insulating layer including the coil pattern and the first and second conductive layers, and a plurality of separated insulating layers are stacked to form a body. Portions of the coil patterns from different separated insulating layers are connected by the via, and a distance between portions of the coil patterns connected by the via is greater than a distance between other portions of the coil patterns.

According to another aspect of the present disclosure, an inductor may include a body in which is disposed a coil formed as a plurality of coil patterns connected by one or more vias. Each via of the one or more vias includes a first conductive layer and a second conductive layer formed on the first conductive layer, and the second conductive layer includes a metal having a hardness lower than that of the first conductive layer.

According to a further aspect of the present disclosure, a method of manufacturing an inductor coil including forming a via in a through hole extending through a first insulating layer to expose a first conductive coil pattern disposed in the first insulating layer. The forming the via includes forming a first conductive layer in the through hole directly on the exposed first conductive coil pattern, and forming a second conductive layer in the through hole on the first conductive layer. The second conductive layer is formed of a material having a hardness lower than that of the first conductive layer, and the second conductive layer extends past an upper surface of the through hole. A second insulating layer having a second conductive coil pattern therein is stacked on the first insulating layer such that the second conductive coil pattern contacts the second conductive layer to form the inductor coil.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Exemplary embodiments in the present disclosure will now be described in detail with reference to the accompanying drawings.

Hereinafter, an inductor 100 according to another exemplary embodiment in the present disclosure will be described.

Figure 1:
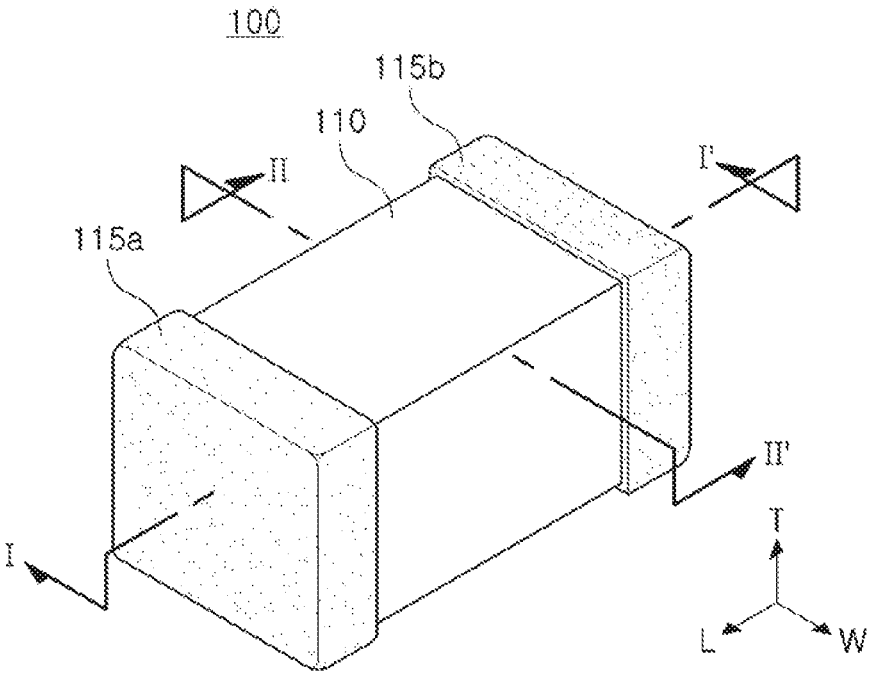
FIG. 1 is a schematic perspective view of an inductor according to an exemplary embodiment in the present disclosure.
Figure 2:
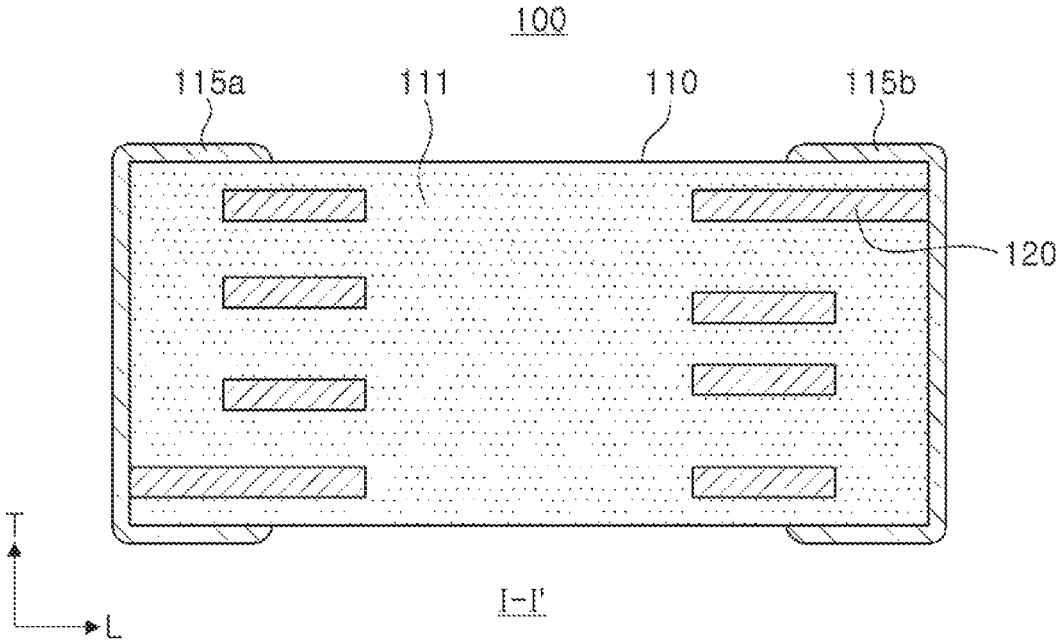
FIG. 2 is a schematic cross-sectional view of an inductor, taken along line I-I' of FIG. 1, according to an exemplary embodiment in the present disclosure.
Figure 3:
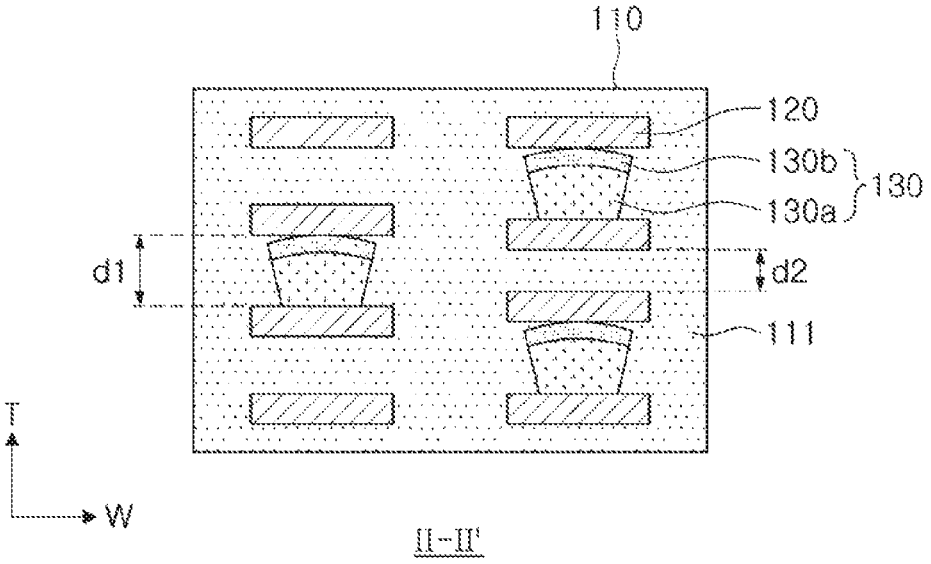
FIG. 3 is a schematic lateral cross-sectional view of an inductor, taken along line II-II' of FIG. 1, according to an exemplary embodiment in the present disclosure.

FIG. 1 is a schematic perspective view of an inductor according to an exemplary embodiment in the present disclosure, FIG. 2 is a schematic cross-sectional view of an inductor such as a view taken along line I-I' in the inductor of FIG. 1 according to an exemplary embodiment in the present disclosure, and FIG. 3 is a schematic lateral cross-sectional view of an inductor such as a view taken along line II-II' in the inductor of FIG. 1 according to an exemplary embodiment in the present disclosure.

Referring to FIGS. 1 to 3, the inductor 100 according to an exemplary embodiment in the present disclosure includes a body 110 in which a coil 120 formed as a plurality of coil patterns interconnected by vias 130 is disposed. Each via 130 includes a first conductive layer 130*a* and a second conductive layer 130*b* formed on the first conductive layer 130*a*. The second conductive layer 130*b* includes a metal different from that included in the first conductive layer 130*a*.

Although not shown, the body 110 may include a first main surface and a second main surface, and a side surface connecting the first and second main surfaces. The side surface may be a surface in a direction perpendicular to a direction in which insulating layers are stacked.

A body of a related art inductor is formed by stacking a plurality of ceramic layers each having a coil pattern formed thereon, and sintering the multilayer ceramic layers. Here, cracking or interlayer delamination may occur due to the presence of a step between a portion in which the coil pattern is formed and a portion in which the coil pattern is not formed.

In the inductor 100 according to an exemplary embodiment in the present disclosure, the body 110 may be formed of an insulating material. Since the body is formed of an insulating material, a step due to the coil pattern is not formed and the occurrence of defects such as cracks is thus prevented or alleviated. Also, since the inductor 100 according to an exemplary embodiment in the present disclosure may have low permittivity, relative to the related art inductor using a ceramic material, parasitic capacitance may be reduced to secure Q characteristics of the inductor.

The body 110 may be formed by stacking insulating layers 111.

The insulating material may be at least one of a photosensitive resin, an epoxy group, an acrylic group, a polyimide group, a phenol group, and a sulfone group.

The insulating layers 111 may each be integrated such that boundaries therebetween may not be readily apparent after being stacked and cured. A shape and dimensions of the body 110 and the number of stacked insulating layers therein are not limited to those shown or described in the exemplary embodiment in the present disclosure.

The body 110 includes a coil 120.

The coil 120 may include a material including silver (Ag) or copper (Cu), or alloys thereof, but is not limited thereto.

End portions of the coil 120 may be led to opposing side surfaces of the body 110 and may be electrically connected to external electrodes.

The coil 120 may have a spiral structure as a plurality of coil patterns are sequentially connected through vias 130 and overlap each other in a stacking direction.

The vias 130 may be spaced apart from each other in each insulating layer 111.

Here, a cover layer (not shown) may be formed on at least one of upper and lower surfaces of the body 110 to protect the coil 120 within the body 110.

The cover layer may be formed by printing paste formed of the same material as that of the insulating layer to have a predetermined thickness.

In the related art inductor, vias for connecting coil patterns were formed using conductive paste or plating. However, conductive paste has high volume resistivity, and thus, an inductor including such vias formed using the conductive paste has a coil with increased resistance which in turn results in a reduction of Q characteristics. An inductor including vias formed using plating has high hardness because it includes only a metal, and thus, interlayer insulation distances may not be uniform when coil patterns are connected (stacked).

Referring to FIG. 3, in the inductor according to an exemplary embodiment in the present disclosure, since the via 130 includes a first conductive layer 130*a* and a second conductive layer 130*b* formed on the first conductive layer and including a metal different from that of the first conductive layer, resistance of the via may be lowered so as to correspondingly lower resistance of the coil 120 to thus enhance Q characteristics of the inductor 100.

Also, the second conductive layer 130*b* may be formed of a material having hardness lower than that of the first conductive layer 130*a*, thereby improving nonuniformity in interlayer distance during a heat pressing process.

Also, by adjusting a thickness of the second conductive layer 130*b*, interlayer connection of the coil 120 may be more uniformly maintained, and when a plurality of insulating layers are stacked, a uniform insulation distance may be secured between coil patterns.

The first conductive layer 130*a* may be formed of at least one of silver (Ag), copper (Cu), and bismuth (Bi), and may be formed of Cu alone but is not limited thereto.

The second conductive layer 130*b* may include a metal having a hardness lower than that of the first conductive layer 130*a*. For example, the second conductive layer 130*b* may include at least one of tin (Sn), Sn—Ag, Sn—Cu, and Sn—Bi.

In one example, the second conductive layer 130*b* may include Sn having hardness of about 1/10 of Cu included in the first conductive layer 130*a*, thus improving nonuniformity in interlayer distances of coil patterns during the heat pressing process.

The Sn—Ag, Sn—Cu, and Sn—Bi used in the second conductive layer 130*b* may be alloys including Sn and having hardness of about 1/10 of Cu included in the first conductive layer 130*a*.

According to an exemplary embodiment in the present disclosure, the first conductive layer 130*a* including Cu may be formed though a plating method.

Also, the second conductive layer 130*b* including at least one of Sn, Sn—Ag, Sn—Cu, and Sn—Bi may be formed on the first conductive layer 130*a* through plating.

When the vias are formed of only Sn to connect coil patterns, the manufacturing process may be simplified. However, grains are increased in the vias in terms of characteristics of Sn, thereby increasing surface roughness.

In turn, the increase in surface roughness of the vias can generate a void when coil patterns are connected, thereby reducing a connection area and degrading reliability.

In the case of forming the vias according to an exemplary embodiment in the present disclosure, since the first conducive layer 130*a* is formed of Cu and the second conductive layer 130*b* is subsequently formed of Sn on the first conductive layer 130*a*, a thickness of Sn may be reduced and surface roughness may be reduced, minimizing creation of a void in an interface when coil patterns are connected.

Also, since Cu having volume resistivity lower than that of Sn is applied to the first conductive layer 130*a*, Q characteristics may be enhanced.

A cross-section of the via 130 may be varied depending on a manufacturing method and may have a fan shape (as shown in FIG. 3), an inverse trapezoid shape, a trapezoid shape, and the like. The cross-section of the via 130 may have a fan shape in which a length of an upper surface the via is greater than a length of a lower surface thereof but is not limited thereto.

External electrodes 115*a* and 115*b* are disposed on opposing surfaces of the body 110.

The external electrodes 115*a* and 115*b* may be formed of a material having excellent electrical conductivity. For example, the external electrodes 115*a* and 115*b* may be formed of a conductive material such as Ag or Cu, or alloys thereof but are not limited thereto.

Also, if necessary, surfaces of the external electrodes 115*a* and 115*b* may be plated with nickel (Ni) or Sn to form a plated layer.

Referring to FIG. 3, in the inductor 100 according to an exemplary embodiment in the present disclosure, a distance d1 between portions of the coil patterns connected by a via 130 is greater than a distance d2 between other portions of the coil patterns (e.g., portions of the coil patterns that are spaced apart from any via).

According to an exemplary embodiment in the present disclosure, since the via 130 includes the first conductive layer 130*a* and the second conductive layer 130*b* formed on the first conductive layer 130*a*, the distance d1 between portions of the coil patterns connected by the via 130 is greater than the distance d2 between other portions of the coil patterns due to the thickness of the second conductive layer 130*b* disposed on the first conductive layer 130*a*.

The thickness of the via 130 for connecting the coil patterns, that is, the thickness of the first conductive layer 130*a* and the second conductive layer 130*b*, may be varied according to distances between the coil patterns.

The thickness of the first conductive layer 130*a* has a value of a ratio of 0.7 to 1.0 of the distance between the coil patterns, that is, the thickness of the interlayer insulating layer (e.g., d2).

Meanwhile, a thickness of the conductive layer 130*b* may be 3.0 to 7.0 μm, but is not limited thereto.

When the second conductive layer 130*b* has a thickness of at a minimum 3.0 μm or greater, a connection state between coil patterns is good.

In cases where a thickness of the second conductive layer 130*b* is less than 3.0 μm, the absolute volume of Sn included in the second conductive layer 130*b* can be too small to fill an interface between the coil patterns and can thus result in a poor connection state.

If the thickness of the second conductive layer 130*b* exceeds 7.0 μm, a thickness of Sn included in the second conductive layer 130*b* is so thick that surface roughness is increased and a void can be generated when coil patterns are connected, reducing a connection area and degrading reliability.

As mentioned above, since the first conductive layer 130*a* has a thickness within a ratio of 0.7 to 1.0 of the thickness of the interlayer insulating layer, and since the thickness of the second conductive layer 130*b* disposed on the first conductive layer 130*a* satisfies the range from 3.0 to 7.0 μm, the distance d1 between portions of the coil patterns connected by the via 130 is greater than the distance d2 between other portions of the coil patterns.

In the inductor according to an exemplary embodiment in the present disclosure, since the coil is formed by connecting the coil patterns by the vias having first and second conductive layers formed of heterogeneous metals, resistance of the coil may be lowered and Q characteristics of the inductor may be enhanced.

Also, since the second conductive layer of the via is formed of a material having strength lower than that of the first conductive layer, nonuniformity in interlayer distance may be improved during heat pressing, such that interlayer connection of the coil may be more uniformly maintained by adjusting a thickness of the second conductive layer.

Hereinafter, a method for manufacturing an inductor according to an exemplary embodiment in the present disclosure will be described.

The method for manufacturing an inductor according to an exemplary embodiment in the present disclosure may include forming a coil pattern 120 on a substrate 10, forming an insulating layer 111 on the substrate 10 to cover the coil pattern 120, forming a through hole 135 in the insulating layer 111, forming a first conductive layer 130*a* within the through hole 135 through plating, forming a second conductive layer 130*b* on the first conductive layer 130*a* through plating to form a via 130 including the first and second conductive layers 130*a* and 130*b*, separating the substrate 10 and the insulating layer 111 including the coil pattern 120 and the first and second conductive layers 130*a* and 130*b*, and stacking a plurality of separated insulating layers 111 to form a body 110. Portions of the coil patterns are connected by the via 130, and a distance between portions of the coil patterns connected by the via 130 is greater than a distance between other portions of the coil patterns.

The insulating layer 111 may be formed of a photosensitive resin, an epoxy group, an acrylic group, a polyimide group, a phenol group, and a sulfone group.

When the insulating layer 111 is formed of a photosensitive resin, the through hole may be formed through a photoresist method, and when the insulating layer 111 is formed of at least one of an epoxy group, an acrylic group, a polyimide group, a phenol group, and a sulfone group, the through hole may be formed using laser drilling.

A shape of a cross-section of the through hole 135 may be varied depending on a manufacturing method and may have a quadrangular shape, an inverse trapezoid shape, a trapezoid shape, and the like. The cross-section of the through hole 135 may have an inverse trapezoid shape but is not limited thereto.

The first conductive layer 130*a* may be formed through a plating method and may be formed of a conductive metal. The conductive metal may be least one of silver (Ag), copper (Cu), and bismuth (Bi), and may be formed of copper (Cu) alone but is not limited thereto.

The second conductive layer 130*b* may include a metal having a hardness lower than that of the first conductive layer 130*a*. For example, the second conductive layer 130*b* may include at least one of Sn, Sn—Ag, Sn—Cu, and Sn—Bi.

The Sn—Ag, Sn—Cu, and Sn—Bi may be alloys including Sn having hardness of about 1/10 of copper included in the first conductive layer 130*a*.

The second conductive layer 130*b* including at least one of Sn, Sn—Ag, Sn—Cu, and Sn—Bi may be formed on the first conductive layer 130*a* through plating.

FIGS. 4A to 4F are schematic cross-sectional views illustrating a sequential process of a method for manufacturing an inductor according to an exemplary embodiment in the present disclosure, specifically illustrating a process of forming a via.

Figure 4A:
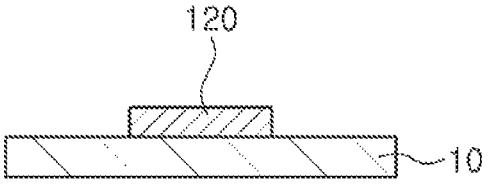
FIGS. 4A to 4F are schematic cross-sectional views illustrating sequential steps of process for manufacturing an inductor according to an exemplary embodiment in the present disclosure.

Referring to FIG. 4A, the coil pattern 120 is formed on the substrate 10.

The substrate 10 may be a copper clad laminate (CCL). The CCL refers to a laminate for a printed wiring board, formed by coating a copper foil on one or opposing surfaces of a substrate, and here, the substrate may be a phenol resin, an epoxy resin, and the like.

The coil pattern 120 may be formed on the CCL through an exposing and developing process.

The coil pattern 120 may include a material including Ag or Cu, or alloys thereof. The coil pattern may be formed of Cu but is not limited thereto.

Figure 4B:
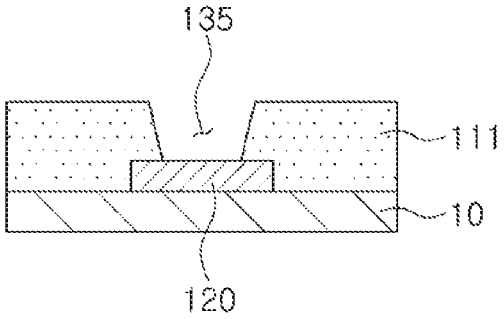

Referring to FIG. 4B, the insulating layer 111 is formed on the substrate 10 to cover the coil pattern 120, and the through hole 135 is formed in the insulating layer 111. The through hole 135 may extend from a surface of the insulating layer 11 to the coil pattern 120.

The insulating layer 111 may be a photosensitive resin. When the insulating layer 111 is a photosensitive resin, the through hole may be formed through a photoresist (PR) process.

The through hole 135 may be formed to be in contact with the coil pattern 120 through the insulating layer 111.

A cross-section of the through hole 135 may have a trapezoid shape when the insulating layer 111 is a negative-type photoresist, and may have an inverse trapezoid shape in which a length of an upper surface thereof is greater than that of a lower surface thereof when the insulating layer 111 is a positive-type photoresist.

Figure 4C:
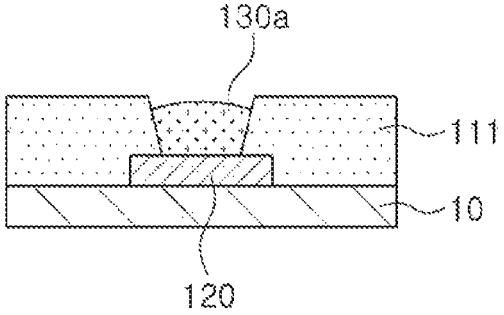

Referring to FIG. 4C, the first conductive layer 130*a* is formed within the through hole 135.

The first conductive layer 130*a* may be formed by an electroplating method, and may be formed of Cu but is not limited thereto.

The first conductive layer 130*a* may be formed in a portion within the through hole 135. A thickness of the first conductive layer 130*a* has a value of 0.7 to 1.0 of a distance between the coil patterns 120, e.g., 0.7 to 1.0 of a thickness of the interlayer insulating layer 111.

Figure 4D:
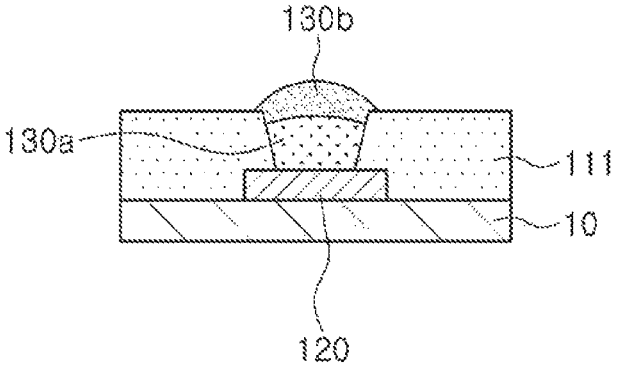

Referring to FIG. 4D, a second conductive layer 130*b* is formed on the first conductive layer 130*a* to fill the inside of the through hole 135.

The via 130 includes the first and second conductive layers 130*a* and 130*b* formed within the through hole 135.

The second conductive layer 130*b* may be formed on the first conductive layer 130*a* through plating.

The second conductive layer 130*b* may include at least one of Sn, Sn—Ag, Sn—Cu, and Sn—Bi.

The second conductive layer 130*b* may have a convex shape on a surface of the insulating layer 111 after plating (e.g., an upper surface of the second conductive layer 130*b* may have a convex shape).

The convex portion of the second conductive layer 130*b* has a predetermined height extending above the upper surface of the insulating layer 111. A height of the convex portion of the second conductive layer 130*b* may be lowered by 1% to 20% during a subsequent stacking and compressing process and internal density thereof may be increased.

A thickness of the second conductive layer 130*b* may be 3.0 to 7.0 μm but is not limited thereto.

The via 130 may include the second conductive layer 130*b*. The convex portion of the second conductive layer 130*b* may serve as a buffer to distribute interlayer stress during the process of stacking and compressing a plurality of insulating layers.

Figure 4E:
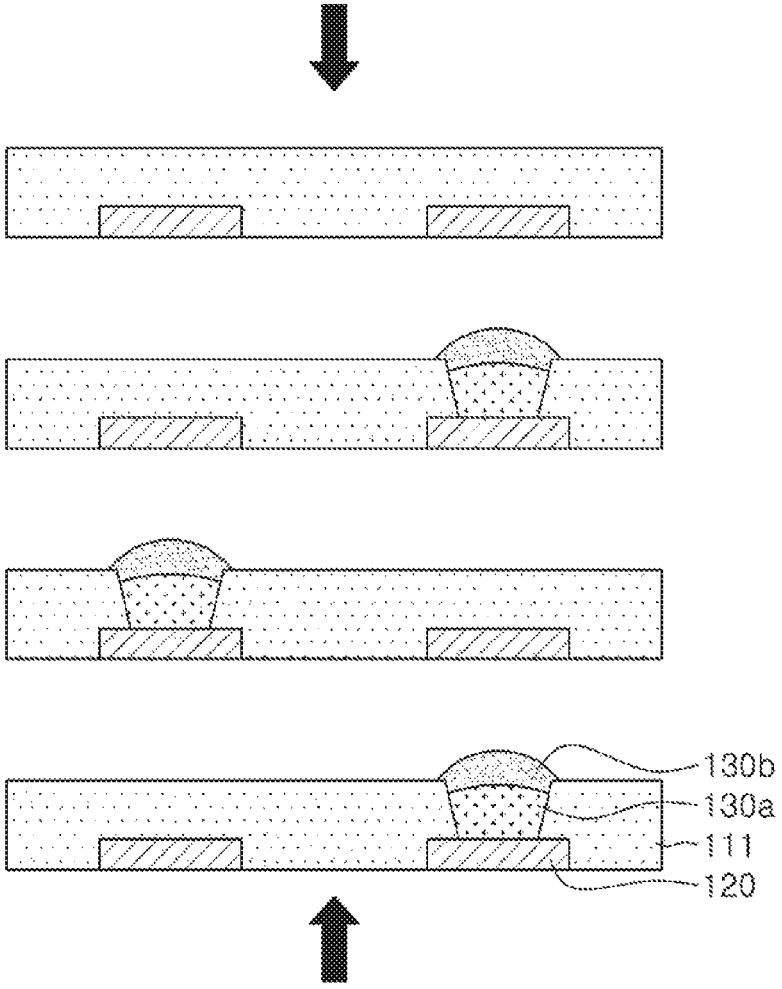
Figure 4F:
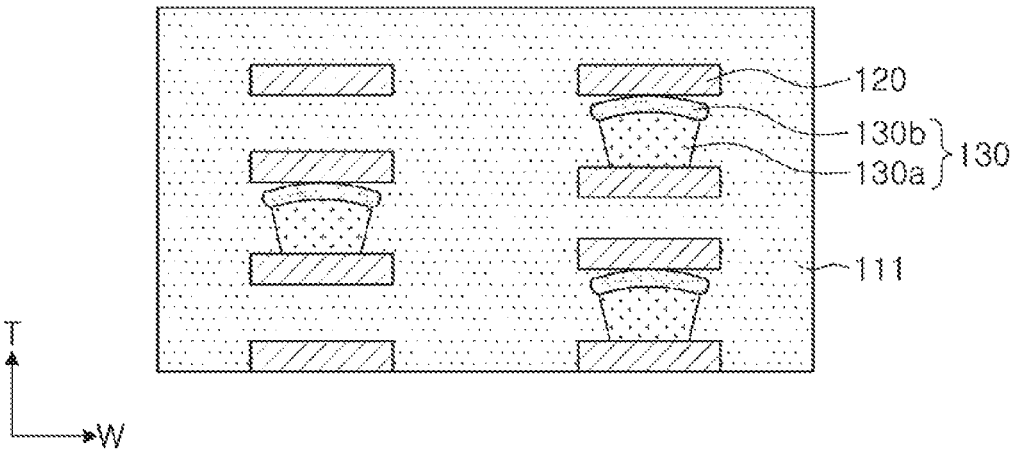

Referring to FIGS. 4E and 4F, the substrate 10 and the insulating layer 111 including the coil pattern 120 and the first and second conductive layers 130*a* and 130*b* are separated, and a plurality of separated insulating layers 111 are stacked to form the body 110.

The substrate 10 may be removed using an etching method.

The plurality of separated insulating layers 111 are collectively stacked, and the plurality of stacked insulating layers are compressed at a high temperature to form the body 110.

In the step of forming the body 110, sintering is not performed at a high temperature and may be performed at a temperature at which the insulating layers 111 and the second conductive layer 130*b* may be cured.

The body 110 may be formed by thermally pressing a plurality of stacked insulating layers 111, and since insulation distances between layers are uniform, resistance of the coil may be lowered, and thus, Q characteristics of the inductor may be enhanced.

In the related art, a sintered metal was used as a via for interlayer connection of the coil patterns. The sintered metal is sintered at a high temperature ranging from 800° C. to 900° C., and since an organic substance is burnt out during a sintering process, the sintered metal does not include the organic substance.

Also, in the related art, since a compression process is performed after interlayer stacking and before the sintering process, the coil patterns and the vias are pressed to be spread laterally to end up with a degradation of capacity of the inductor and an interlayer short circuit.

Meanwhile, when a via for interlayer connection is formed using curable conductive paste in manufacturing an inductor as in the related art, electrical resistance is high, relative to sintering-type paste, increasing resistance and degrading Q characteristics of the inductor.

In another method, when a via is formed using only an electroplating method, since the via is formed of only a metal, the via has high strength. Thus, although the via formed through plating has a convex portion, increased pressure may be applied to a portion where the convex portion is not present when insulating layers are stacked and compressed, making distances between insulating layers nonuniform due to fluidity of the insulating layers. Also, in the case of forming the convex portion through plating, it is difficult to form convex portions having a regular size due to plating variations and a difference in height between convex portions may make distances between the insulating layers nonuniform when the insulating layers are stacked.

To address these shortcomings, the inductor 100 according to an exemplary embodiment of the present disclosure includes the via 130 including the first and second conductive layers 130*a* and 130*b*. In detail, since the via 130 includes the first conductive layer formed through an electroplating method and the second conductive layer formed through plating and including a metal having a hardness lower than that of the first conductive layer, electric resistance of the coil may be lowered to enhance Q characteristics of the inductor 100. Also, when the plurality of insulating layers are stacked, interlayer stress may be distributed due to the presence of the second conductive layer having the lower hardness, whereby interlayer insulation distances may be uniform.

The vias 130 may be spaced apart from each other between the insulating layers 111.

The vias 130 may connect the coil patterns 120 disposed up and down in different parallel layers to form the coil 120.

End portions of the coil 120 may be led to opposing side surfaces of the body 110 and electrically connected to the outside by external electrodes formed on the opposing side surfaces.

The body 110 may be compressed and cured during a process such as compression, vacuum pressing, and the like, such that a packing factor of the body 110 is maximized.

The body 110 manufactured as a bar may be cut to chip units to manufacture a plurality of bodies 110. Accordingly, manufacturing cost of the inductor may be lowered and high productivity may be secured.

FIGS. 5A to 5F are schematic cross-sectional views illustrating a sequential process of a method for manufacturing an inductor according to another exemplary embodiment in the present disclosure.

Descriptions of the same components as those illustrated in FIGS. 4A to 4F, among components illustrated in FIGS. 5A to 5F, will be omitted.

Figure 5A:
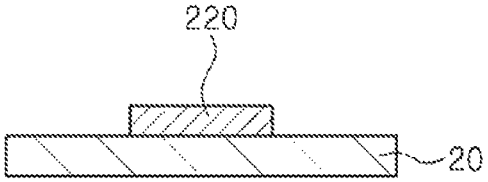
FIGS. 5A to 5F are schematic cross-sectional views illustrating sequential steps of process for manufacturing an inductor according to another exemplary embodiment in the present disclosure.

Referring to FIG. 5A, a coil pattern 220 is formed on a substrate 20.

Figure 5B:
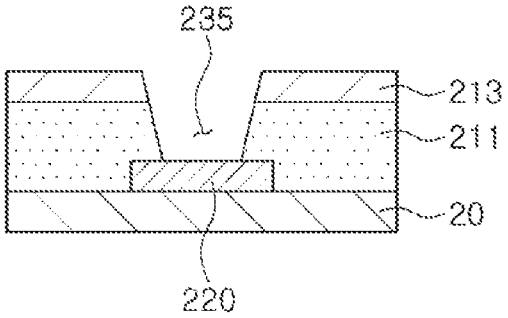

Referring to FIG. 5B, an insulating layer 211 is formed on the substrate 20 to cover the coil pattern 220, and a through hole 235 is formed in the insulating layer 211.

The insulating layer 211 may be formed of at least one of an epoxy group, an acrylic group, a polyimide group, a phenol group, and a sulfone group.

The insulating layer 211 may be formed together with a carrier film 213 on the substrate 20.

The carrier film 213 may have adhesion on one surface thereof and may be adhered to the insulating layer 211 so as to be disposed. The carrier film 213 may be a polyethylene terephthalate (PET) film but is not limited thereto.

When the insulating layer 211 is formed of at least one of the epoxy group, the acrylic group, the polyimide group, the phenol group, and the sulfone group, the through hole 235 may be formed using laser drilling.

The through hole 235 may be in contact with the coil pattern 220 through the carrier film 213 and the insulating layer 211.

Figure 5C:
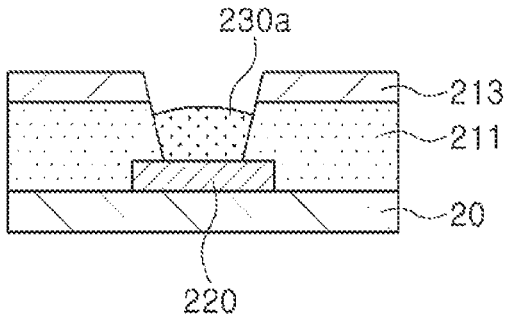

Referring to FIG. 5C, a first conductive layer 230*a* is formed within the through hole 235.

The first conductive layer 230*a* may be formed through an electroplating method, and a material thereof may be any one of Ag, Cu, and Bi, and, in particular, Cu.

The first conductive layer 230*a* is formed in a portion within the through hole 235.

Figure 5D:
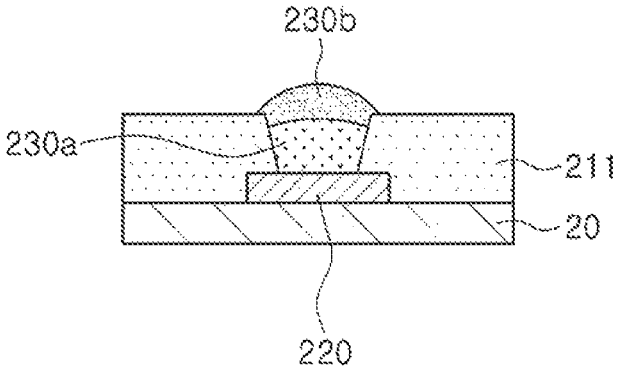

Referring to FIG. 5D, the conductive metal is plated on the first conductive layer 230*a* to fill the inside of the through hole 235 to form a second conductive layer 230*b*.

The via 230 includes the first and second conductive layers 230*a* and 230*b* formed within the through hole 235.

The second conductive layer 230*b* may have a convex shape extending above a surface of the insulating layer 211 after plating.

The convex portion of the second conductive layer 230*b* has a predetermined height from the surface of the insulating layer 211. A height of the convex portion of the second conductive layer 230*b* may be lowered by 1% to 20% during a subsequent stacking and compressing process and internal density thereof may be increased.

The via 230 according to an exemplary embodiment in the present disclosure may include the second conductive layer 230*b*. The convex portion of the second conductive layer 230*b* may serve as a buffer to distribute interlayer stress during the process of stacking and compressing a plurality of insulating layers. Accordingly, a predetermined insulation distance may be maintained between the insulating layers.

Figure 5E:
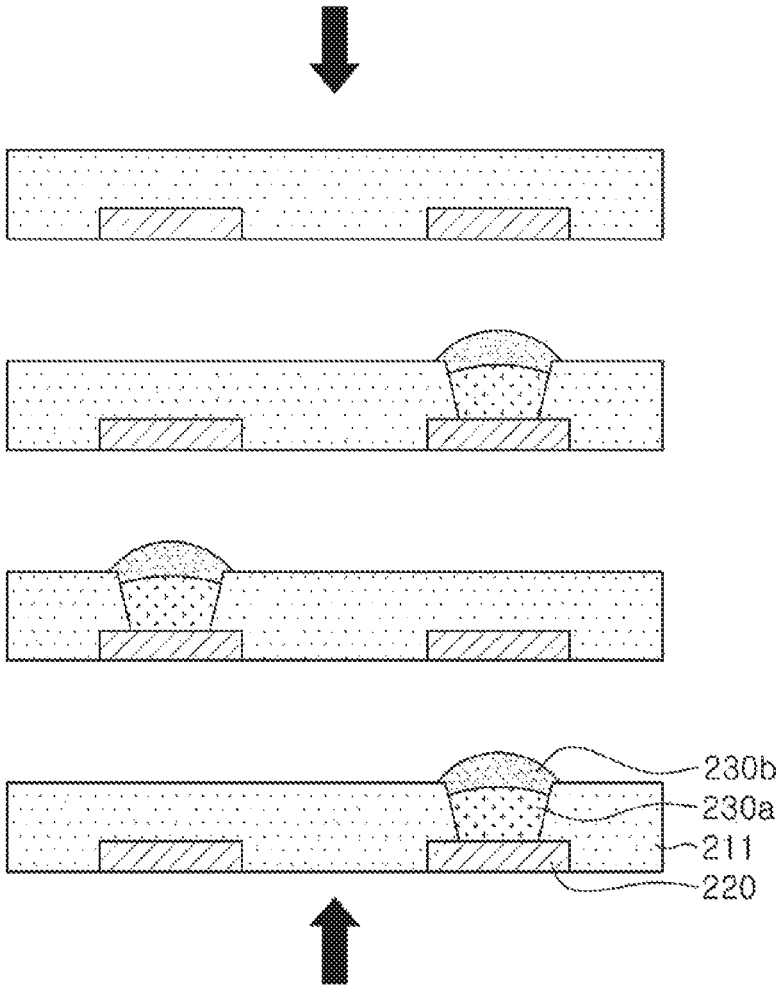
Figure 5F:
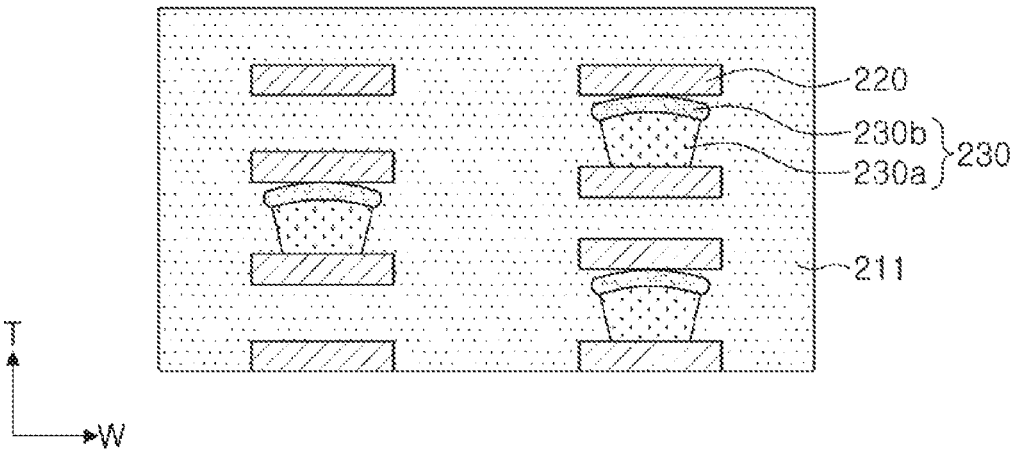

Referring to FIGS. 5E and 5F, the substrate 20 and the insulating layer 211 including the coil pattern 220 and the first and second conductive layers 230*a* and 230*b* are separated, and a plurality of separated insulating layers 211 are stacked to form the body 210.

The substrate 20 may be removed using an etching method.

The plurality of separated insulating layers 211 are collectively stacked and compressed at a high temperature to form the body 210.

Thereafter, although not shown, external electrodes are formed on opposing surfaces of the body 210.

The external electrodes may be formed by dipping the body 210 into paste for forming external electrode.

The paste for forming external electrode includes conductive powder, and the conductive powder may include a material including at least one of Ag and Cu, or alloys thereof, but is not limited thereto.

As set forth above, in the inductor according to an exemplary embodiment in the present disclosure, the coil may be formed by connecting coil patterns by vias each including first and second conductive layers formed of heterogeneous metals, whereby resistance of the coil may be lowered and Q characteristics of the inductor may be enhanced.

Also, since the second conductive layer is formed of a material having strength lower than that of the first conductive layer, nonuniformity of interlayer distances during a heat pressing process may be improved, and interlayer connection of the coil may be uniformly maintained by adjusting a thickness of the second conductive layer.

While example embodiments have been shown and described above, it will be apparent to those skilled in the art that modifications and variations could be made without departing from the scope of the present invention as defined by the appended claims.

What is claimed is:

1. An inductor comprising:

a body in which a coil including a plurality of coil patterns connected by one or more vias is disposed, wherein the plurality of coil patterns comprise a first coil pattern and a second coil pattern, and the one or more vias include a first via connecting a connection part of the first coil pattern and a connection part of the second coil pattern to each other, a first distance, in a thickness direction of the inductor, between the connection part of the first coil pattern and the connection part of the second coil pattern is greater than a second distance, in the thickness direction of the inductor, between another part of the first coil pattern and another part of the second coil pattern, the first via includes a first conductive layer and a second conductive layer disposed on the first conductive layer, a side surface of the connection part of the first coil pattern connected to the via is spaced apart from a side surface of the another part of the first coil pattern by an insulating material of the body, and a side surface of the connection part of the second coil pattern connected to the via is spaced apart from a side surface of the another part of the second coil pattern by the insulating material of the body.

2. The inductor of claim 1, wherein the first conductive layer has a thickness within a ratio of 0.7 to 1.0 of the second distance.

3. The inductor of claim 1, wherein a thickness of the second conductive layer is 3.0 μm to 7.0 μm.

4. The inductor of claim 1, wherein the second conductive layer includes a metal having a hardness lower than that of the first conductive layer.

5. The inductor of claim 1, wherein the first and second conductive layers have different compositions, and the first conductive layer includes at least one of silver (Ag), copper (Cu), and bismuth (Bi).

6. The inductor of claim 1, wherein the first and second conductive layers have different compositions, and the second conductive layer includes at least one of tin (Sn), Sn—Ag, Sn—Cu, and Sn—Bi.

7. The inductor of claim 1, wherein the body is formed of an insulating material.

8. The inductor of claim 7, wherein the insulating material is at least one of a photosensitive resin, an epoxy group, an acrylic group, a polyimide group, a phenol group, and a sulfone group.

9. The inductor of claim 1, wherein each of an upper and a lower surface of the connection part of the first coil pattern opposing each other is a flat surface, and each of an upper and a lower surface of the connection part of the second coil pattern opposing each other is a flat surface.

10. The inductor of claim 1, wherein the first via is the only via disposed between the first coil pattern and the second coil pattern.

11. An inductor comprising a body in which a coil including a plurality of coil patterns connected by one or more vias is disposed, wherein the plurality of coil patterns comprise a first coil pattern and a second coil pattern, and the one or more vias include a first via connecting the first coil pattern and the second coil pattern to each other, the first via includes a first conductive layer having a convex end, and a second conductive layer disposed on the convex end of the first conductive layer and connecting the first conducive layer to the second coil pattern, and the second conductive layer has a convex end facing the second coil pattern.

12. The inductor of claim 11, wherein the first conductive layer has a thickness within a ratio of 0.7 to 1.0 of a distance between portions of the first and second coil patterns spaced apart from the first via.

13. The inductor of claim 11, wherein a thickness of the second conductive layer is 3.0 μm to 7.0 μm.

14. The inductor of claim 11, wherein the second conductive layer includes a metal having a hardness lower than that of the first conductive layer.

15. The inductor of claim 11, wherein the first and second conductive layers have different compositions, and the first conductive layer includes at least one of silver (Ag), copper (Cu), and bismuth (Bi).

16. The inductor of claim 11, wherein the first and second conductive layers have different compositions, and the second conductive layer includes at least one of tin (Sn), Sn—Ag, Sn—Cu, and Sn—Bi.

17. The inductor of claim 11, wherein the body is formed of an insulating material.

18. The inductor of claim 17, wherein the insulating material is at least one of a photosensitive resin, an epoxy group, an acrylic group, a polyimide group, a phenol group, and a sulfone group.

19. The inductor of claim 11, wherein a central portion of the convex end of the second conductive layer is in contact with the second coil pattern, and edge portions of the convex end of the second conductive layer surrounding the central portion thereof are spaced apart from the second coil pattern.

* * * * *